United States Patent [19]

Figari

[11] Patent Number: 4,573,303

[45] Date of Patent: Mar. 4, 1986

[54] METHOD OF CASTING FLOORS AND CEILINGS OF BUILDINGS AND A PANEL FOR USE THEREIN

[76] Inventor: Andres G. Figari, Calle 77-801 Apt. 302, Bogota, Colombia

[21] Appl. No.: 462,434

[22] Filed: Jan. 31, 1983

[51] Int. Cl.[4] ..... E04B 1/16; E04B 5/32

[52] U.S. Cl. ..... 52/743; 52/320; 52/593; 264/35

[58] Field of Search ..... 52/593, 411, 351, 357, 52/319, 320, 321, 323, 325, 743, 744; 264/34, 35

[56] References Cited

U.S. PATENT DOCUMENTS

| | | | |
|---|---|---|---|
| 1,087,644 | 2/1914 | Crane | 52/319 |
| 3,093,935 | 6/1963 | Dunn | 52/593 |

FOREIGN PATENT DOCUMENTS

| | | | |
|---|---|---|---|
| 782660 | 6/1935 | France | 52/325 |
| 932379 | 3/1948 | France | 52/320 |
| 328979 | 8/1935 | Italy | 52/325 |
| 671433 | 10/1964 | Italy | 52/325 |
| 496235 | 11/1938 | United Kingdom . | |
| 785499 | 10/1957 | United Kingdom | 52/320 |

*Primary Examiner*—Donald G. Kelly
*Assistant Examiner*—Michael Safavi
*Attorney, Agent, or Firm*—Kerkam, Stowell Kondracki & Clarke

[57] ABSTRACT

A method of constructing floor castings for building comprising the steps of forming a frame or ribbing (6) of beams, supporting panels (1) between the beams to provide substantially the lower surface of the floor at a level below the lower edges of the beams, temporarily securing flat bridging means (9) against the lower surfaces of the panels to continuously bridge the gaps therebetween partially occupied by the supporting beams and pouring a layer (13) of concrete over the structure comprising the panels and beams to form, when set, a composite cast floor having a substantially smooth and continuous lower surface after removal of the bridging means.

7 Claims, 5 Drawing Figures

METHOD OF CASTING FLOORS AND CEILINGS OF BUILDINGS AND A PANEL FOR USE THEREIN

This invention relates to the construction of cast floors (which expression shall be taken to include ceilings) for buildings, and particularly but not exclusively to methods of casting floors for multi-storey buildings to improve the finish of the underside of such floors which serve as the ceiling of the lower storey.

At present, the most common type of floor used in the construction of multi-storey buildings is the cast or ribbed floor of reinforced concrete including prefabricated pieces. The procedure for the construction of these floors generally includes the following stages: the placing of light girders, the erection of provisional shoring, the suspension of prefabricated blocks or pieces and the pouring on of a concrete compression layer.

This procedure has, in general, the advantages of providing good strength, both under tension and compression; lightness, as hollow blocks or pieces are used for the casting; and also of eliminating plank-moulding.

However, these advantages are more related to achieving a strong structure than to the finish of the surfaces of the structure.

This is particularly true regarding the lower surface or ceiling, as the upper floor surface is benefited by the continuous concrete layer, on which it is easier to apply a uniform finish or place the floor coverings. But in the case of the ceiling, the finishing of this surface is accomplished after the concrete has set and the structure is monolithic, and the shoring has been removed. The exposed lower surface is irregular, both in relief and with regard to the different materials which make it up. For this reason, the operation of smoothing down to a uniform finish presents a number of disadvantages, the main one being the necessity of working against gravity.

Other disadvantages usually arise from the type of block or piece used for the casting itself. If cap vaults are used, stripped of their lower smooth base, a number of holes will remain and it will be necessary to provide plates or tiles or plaster panels to hide them. If cap vaults with a smooth lower base are used, there is always the risk of there having been infiltrations of concrete which give rise to blobs which must be removed or covered, and moreover in this case the need for a layer of render is not eliminated.

It is therefore evident that the use of a construction method that will reduce to a minimum, or even eliminate finishing or rendering operations, particularly on the lower surface would be highly desirable.

According to the present invention, there is provided a method of casting floors and ceilings of buildings, comprising the steps of (a) forming a frame or ribbing of parallel beams, (b) supporting panels between adjacent beams by means of shoulders extending along two opposed edges of each panel engaging the beams, the bottom of the shoulders being at a height above the base of the panel, (c) temporarily securing flat bridging means against the base of the panels to form continuous bridges spanning the gaps containing the beams between adjacent panels, (d) pouring concrete over the structure comprising the beams and panels to form, when set, a composite cast floor/ceiling having a substantially smooth and continuous lower surface, and (e) removing the bridging means.

Between each pair of adjacent beams, several panels may be supported, thus forming a row of such panels between each pair of beams. Adjacent panels in each row should abut each other and preferably the abutting edges of each panel are stepped so as to form, together with the adjacent panel, a lap joint.

Although it is possible to support the bridging means in place across the gaps between the panels occupied by the supporting girders by means of suitable shoring, this would add considerably to the complexity and expense of the construction procedure. Accordingly, it is preferred to provide on the panels near those edges which are to be supported by beams, fixing means for use in temporarily securing the bridging means across the gap occupied by the supporting beams. These fixing means, which in order to retain the smooth profile of the panel surface, conveniently comprise clamps, held by nuts embedded within the panels, and corresponding bolts. Regular spacing of these fixing means is desirable to ensure continuous contact between the bridging means and the panel surfaces, and to prevent warping where wooden boards are used to provide the bridging means. Both of these factors contribute to a smoother finish in the completed structure.

Other features of the present invention will become apparent from the following description of a preferred method of constructing a cast floor for a building, given by way of example only, with reference to the accompanying drawings, in which.

In these drawings, the reference number 1 refers to a plate or panel, for use in accordance with the invention in constructing floor castings, with advantageous results, especially as regards the finishing of the surface which will constitute the ceilings of the lower storey.

The panel 1 is moulded from a base of a preferably homogeneous mixture of cement mortar, sand, expanded polystyrene and water. Typically the quantities of solids, stated in parts per thousand, are 350 parts of cement, 450 parts of sand and 16 parts of expanded polystyrene; the rest being water.

Figure 1:
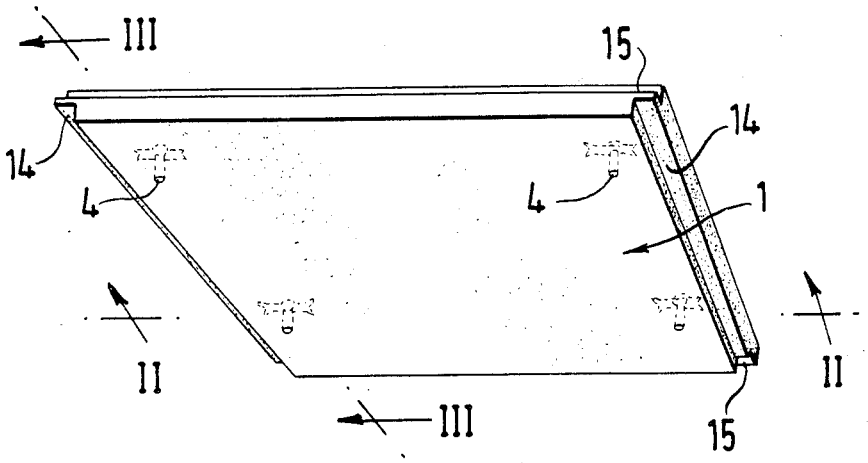
FIG. 1 shows a perspective view from below of a flat panel which will form part of a floor casting.
Figure 2:
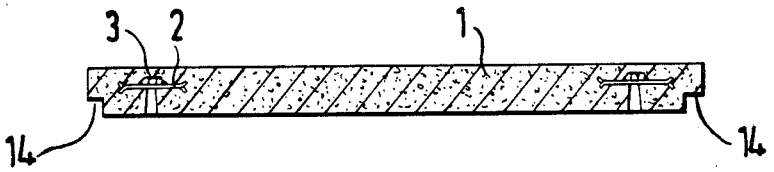
FIGS. 2 and 3 show, respectively sections along the lines II—II and III—III of FIG. 1.
Figure 3:
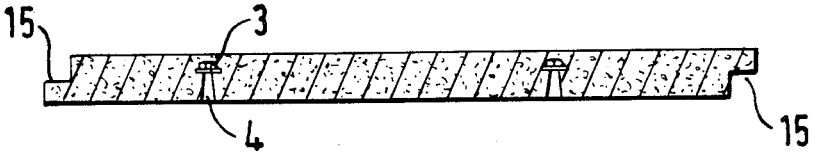

As can be seen in FIGS. 1 to 3, the panel 1 is rectangular, although it could equally well be square, with projections 14, 15 along all four edges half as thick as the panel. The projections 14 on the longer edges are an extension of the upper surface of the plate and will hereafter be called 'shoulders', whereas the projection 15 on one of the shorter edges is an extension of the upper surface and the other an extension of the lower surface of the panel.

During the moulding of panel 1 a number of nuts and retaining plates 2 are embedded within the panel. The ends of the plates 2 are forked and bent in opposite directions, in order to achieve better anchoring in the mass of the panel 1. In the example shown, there are four plates and nuts located in the region of the four corners of panel 1. Nevertheless, it should be understood that both the location and number may change according to the circumstances of its use.

On the lower surface of the panel 1 and in alignment with each of the nuts 3, holes 4 are drilled. These holes 4 are slightly conical in shape (FIGS. 2 and 3) to facilitate the entry of fixing bolts.

Once the network of beams has been designed these are supported by props 5. The beams may be made from different types of material, for example of prestressed concrete, iron, mixed iron and concrete etc. In the example illustrated, it has been considered preferable to provide these beams in the form of frames based on round-section iron bars. This frame receives the general reference number 6, and it should be understood that any other beams of this type (trusses, open web joists) etc., could also be used.

Figure 4:
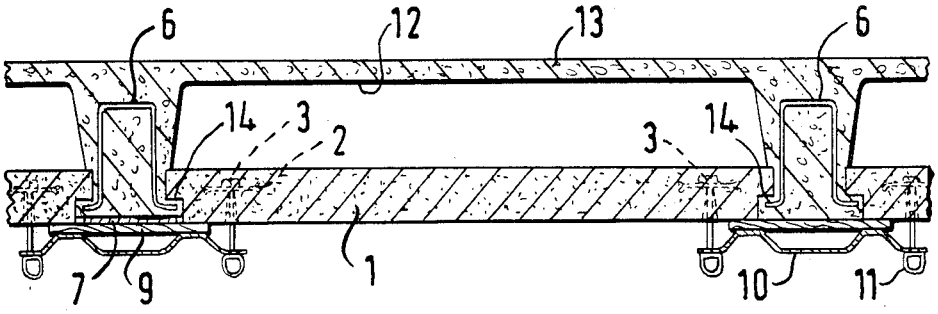
FIG. 4 is a vertical section of the casting of a floor using the panel shown in FIG. 1.

The panels 1 rest on the beams 6 by means of the shoulders 14 on their longer edges as shown in FIG. 4. Now the thickness of the part of the panel 1 between the bottom of the shoulders 14 and the base of the panel may be greater in some places than the step provided by the ledge part of the frame girder 6 on which the shoulders are intended to rest. For this reason small supplementary pieces or chocks 7 have been designed (left hand side of FIG. 4) which can be inserted at suitable intervals during the shoring, or which may even be welded to the frame 6. It will be understood that the use of these chocks 7 depends to a great extent on the type of beam used.

The props 5 are aligned with the beams 6 and their rows are stiffened by means of cross bars 8. Over these bars 8, bridging boards 9 are placed continuously to bridge the gaps between adjacent rows of panels occupied by the beams. With this arrangement, it will be observed that the lower surfaces of the panels 1, the lower surface of the chocks 7 and the upper surface of the bridging boards 9 are all disposed in the same horizontal plane, (FIG. 4).

One main object of the present invention is that the surface of the ceiling obtained be a surface which makes later rendering unnecessary and which is suitable for painting and decorating operations. The panels 1 have a smooth surface because of their manner of manufacture, and consequently any hindrances to uniformity will appear in the region of the beams 6.

To avoid these hindrances, it is necessary to ensure satisfactory levelling and fit between the upper surface of boards 9 and the lower surfaces of the panel 1 adjacent the gaps between them occupied by the beams 6. This levelling will be achieved by increasing the number of support points of the said boards 9 for example by increasing the number of props 5 and bars 8, but this would make the work more complicated and expensive. At this point the usefulness of the nuts 3 and plates 2 incorporated into the panels 1 and communicating with the lower surface through holes 4 will become apparent.

In the embodiment shown, the width of the boards 9 is less than the distance between the most closely spaced holes 4 in the panels of adjacent panel rows on opposite sides of a supporting beam. The boards 9 are held in place by means of clamps 10 which are held in place by eyebolts 11 which pass through holes near the end of each clamp and through the holes 4 in the panel 1 and are screwed into nuts 3. As shown, the pairs of fixing points to which each of the clamps 10 are secured are located directly opposite one another on opposed sides of the gap to be bridged by the boards 9 and are regularly spaced therealong.

Thus the boards 9 are strongly secured against the lower surface of plates 1 at many points, contributing to provide the desired levelness. It will also be noted that the provision of a large number of supporting points for boards 9 reduces warping of wooden boards due to the moisture in the concrete poured onto them, thus enabling them to be used over again. Alternatively, the boards 9 could of course be of a material unaffected by moisture.

On the upper surface of the panels 1, spacing elements 12 are placed, the object of which is to reduce the thickness of the concrete layer which will be poured over them (and hence the weight of the floor). The elements are located at points where this can safely be done without reducing the strength of the floor. These elements, which may be hollow, may be made of any material that is cheap and mouldable which only needs to have the necessary strength to withstand the weight of the concrete layer (not very thick in this area) until it has set. Alternatively, solid blocks of light material may be used for the same purpose.

Next, a layer 13 of concrete is poured over the whole structure, filling the spaces of open-structure frame beams 6 and covering the spacing elements 12 until the thickness of concrete required over these for the necessary strength of the floor is achieved. In order to achieve the necessary compactness of the concrete, mechanical compacting is recommended.

Figure 5:
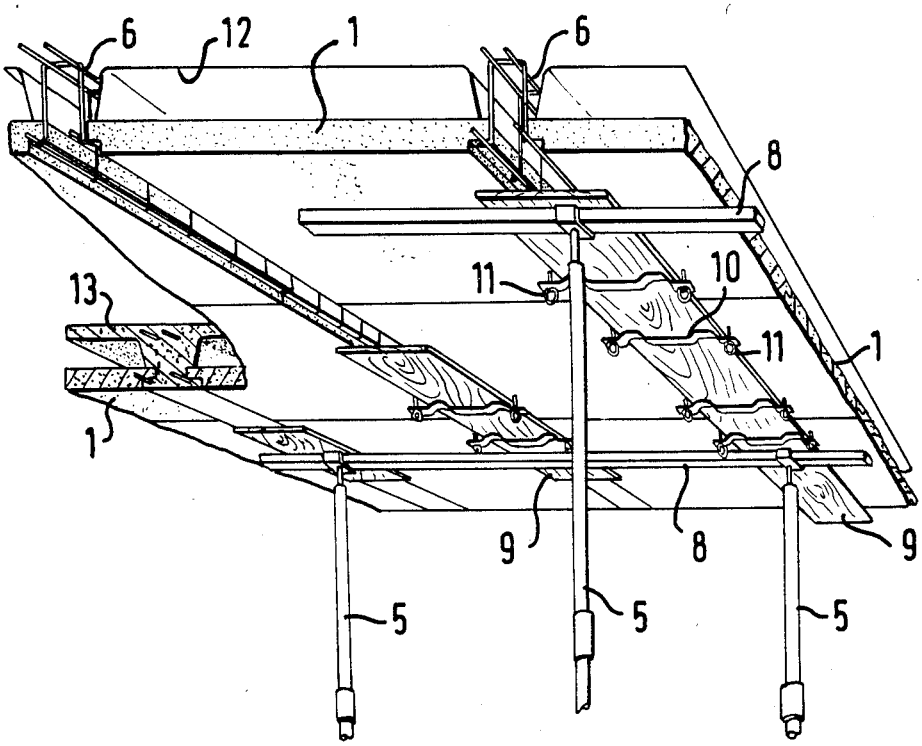
FIG. 5 is a perspective schematic view from below showing the use of several panels in a floor casting, both during the construction procedure and, towards the left, after the casting has set.

Once the concrete layer 13 has set, the shoring 5 and clamps 10 are removed, leaving a lower surface of the casting which will look like that shown in the lower left hand part of FIG. 5. This surface offers sufficient smoothness and uniformity, after filling in the holes 4, to be suitable for receiving priming, painting, papering or other planned decoration, without the necessity of prior rendering.

Naturally, numerous variations and substitutions to the described process can be made without departing from the scope of the invention. For example the panel 1 formed from the previously mentioned materials and proportions, will have a weight of approximately 25 kg, for dimensions of $70\times80$ cm and a thickness of approximately 6 cm, with a working load of 70 to 80 kp/cm$^2$ (more than enough to support the elements 12 and concrete layer 13 until it has set). The proportion and dimensions could of course be changed to obtain a different weight and breaking strain. Also the weight-reducing agent used in the panels need not be expanded polystyrene and, for example, an aerating agent may be used.

What is claimed is:

1. A method of casting floors and ceilings of buildings, comprising the steps of (a) forming a frame or ribbing of parallel beams extending across the whole length or width of the floor, said beams being of an open framework construction to allow concrete to pass therethrough, (b) supporting panels between adjacent beams by means of shoulders extending along two opposed edges of each panel engaging the beams, the bottom of the shoulders being at a height above the base of the panel, (c) temporarily securing flat bridging means against the bases of the panels to form continuous bridges spanning the gaps containing the beams between adjacent panels, (d) pouring concrete over the structure comprising the beams and panels to form, when set, a composite cast floor/ceiling having a substantially smooth and continuous lower surface, and (e) removing the bridging means, wherein each bridging means is pressed against the bases of the panels on opposed sides of the gap bridged by the bridging means partly by fixing means secured to the panels, wherein the said fixing means comprises one or more clamps anchored to the panels on opposed sides of the gap bridged by the bridging means, and wherein each clamp is anchored by means of a bolt co-operating with a nut embedded within the respective panel and accessible through a communicating bore in the base of the panel.

2. A method as claimed in claim 1, wherein the nut is held captive within the bore by means of a locking plate securely embedded within the panel.

3. A method as claimed in claim 1, wherein the disposition of the fixing means on the panels is such that when the panels are supported in position by the beams, the fixing means are regularly disposed along the gap.

4. A method as claimed in claim 1, wherein hollow enclosures or blocks of light material are supported on the upper surfaces of the panels before concrete is poured over the structure to be embedded within the casing to provide a generally lighter construction.

5. A method as claimed in claim 1 wherein between each pair of adjacent beams, a plurality of panels are supported in rows, adjacent panels in each row abutting one another along their unsupported edges.

6. A mehod as claimed in claim 5 wherein the abutting edges of adjacent panels are so formed as to provide a lap joint therebetween.

7. A method as claimed in claim 1, wherein the disposition of the nuts in the panels is such that, when the panels are supported in position by the beams, the clamps are regularly disposed along the gap.

* * * * *

UNITED STATES PATENT AND TRADEMARK OFFICE

CERTIFICATE OF CORRECTION

PATENT NO. : 4,573,303

DATED : March 4, 1986

INVENTOR(S) : Andres G. FIGARI

It is certified that error appears in the above-identified patent and that said Letters Patent is hereby corrected as shown below:

On the Title Page add:

[30] Priority January 29, 1982
United Kingdom 8,202,562

Signed and Sealed this

Twenty-second Day of September, 1987

*Attest:*

DONALD J. QUIGG

*Attesting Officer* *Commissioner of Patents and Trademarks*